US005249919A

United States Patent [19]

Sishtla et al.

[11] Patent Number: 5,249,919

[45] Date of Patent: Oct. 5, 1993

[54] METHOD OF MOUNTING SILENCER IN CENTRIFUGAL COMPRESSOR COLLECTOR

[75] Inventors: Vishnu Sishtla, Cicero; James Byrne, Liverpool, both of N.Y.

[73] Assignee: Carrier Corporation, Syracuse, N.Y.

[21] Appl. No.: 995,063

[22] Filed: Dec. 22, 1992

[51] Int. Cl.[5] ..... F04D 29/66

[52] U.S. Cl. ..... 415/119; 415/196; 417/312; 181/202; 181/403

[58] Field of Search ..... 415/119, 128, 196, 197, 415/214.1; 181/202, 209, 219, 403; 417/312

[56] References Cited

U.S. PATENT DOCUMENTS

| | | | |
|---|---|---|---|
| 1,743,916 | 1/1930 | Hargis | 415/128 |
| 2,933,287 | 4/1960 | Caddell | 415/119 |
| 3,360,193 | 12/1967 | Harris et al. | 415/119 |
| 4,504,188 | 3/1985 | Traver et al. | 415/119 |
| 4,650,396 | 3/1987 | Schwarz | 415/128 |
| 5,110,266 | 5/1992 | Toyoshima et al. | 417/312 |
| 5,173,020 | 12/1992 | Ebbing et al. | 415/119 |

FOREIGN PATENT DOCUMENTS

| | | | |
|---|---|---|---|
| 132008 | 10/1979 | Japan | 415/214.1 |
| 226298 | 12/1984 | Japan | 415/196 |

*Primary Examiner*—Edward K. Look
*Assistant Examiner*—James A. Larson

[57] ABSTRACT

A centrifugal compressor is provided with a collector for receiving refrigerant from the diffuser, and sound absorbent silencer segments are placed within the collector and retained in place against one wall thereof. The silencer segments are held in place by machine screws that penetrate graduated openings in the side wall of the collector. The machine screw shaft fits a threaded nipple on the silencer segment that also fits into the opening. A sealing plug is disposed in a wide part of the opening above the machine screw head to prevent leakage of the compressed refrigerant.

5 Claims, 4 Drawing Sheets

METHOD OF MOUNTING SILENCER IN CENTRIFUGAL COMPRESSOR COLLECTOR

BACKGROUND OF THE INVENTION

This invention relates generally to centrifugal compressors and is more particularly concerned with the installation of a silencer arrangement within the collector of the centrifugal compressor.

Centrifugal compressors are frequently incorporated in large air conditioning systems. These compressors have a number of components that generate sound and vibration, such as the motor, gearing, impeller, diffuser, condenser, cooler and discharge lines. Besides design considerations to reduce sound generation at their sources, it is conventional to reduce sound with sound absorbing silencers, such as external, surface applied materials. It is also the practice to install internal silencers in the discharge line of the compressor. These silencers employ an acoustically absorbent material such as glass fibers, mineral fibers, Dacron or other natural or synthetic material. These devices are usually installed within the discharge pipe of the centrifugal compressor by welding or otherwise securing a silencer assembly to the inner sidewalls of the discharge pipe. Because of the relatively small size of the discharge pipe and the shortage of possible axial locations to install the silencer, the applicability of their approach has been severely limited. Further, when welding is carried out in positions adjacent to the absorptive material within the silencers, the sound absorbing material can be damaged from the resulting heat. Further, the silencer in the discharge pipe causes additional pressure drop due to blockage, resulting in higher power for a given cooler and condenser pressures.

An alternative to this approach is simply to replace a portion of the discharge pipe with a replacement section that incorporates a silencer device. These replacement sections require special attachment structure, such as mating flanges, and thus become relatively expensive because of excessive requirements for time and materials to construct them.

A more recent approach is to install a sound absorbing silencer within the compressor, so that most of the noise can be absorbed as close to the dominant noise source as possible. To do this, a preferred approach has been to locate sound absorbing material into the annular discharge chamber, or volute, of the compressor. However, it is difficult to install the absorptive material inside the volute, and even more difficult to secure the material in circumferentially spaced locations within the volute. Because the volute is a pressure containing chamber, installing the silencers through holes penetrating the chamber walls could result in unacceptable losses of the compressed refrigerant. Also because the housing of the compressor, including the discharge chamber, is typically formed of cast iron, welding the silencer devices to the walls of the discharge chamber is impractical. Adhesives can be impractical a well because of incompatibility with the refrigerants, and lack of strength and reliability. Additionally, the silencer arrangement should be positively retained to prevent any movement by the refrigerant flowing past the silencer.

A previous proposed solution to this problem is described in U.S. patent application Ser. No. 07/656,537 filed Feb. 19, 1991, having a common assignee herewith. In that approach, silencer elements, i.e. flat silencer, pans, are installed against a radially extending wall of the discharge chamber or volute, prior to the final assembly of the compressor diffuser apparatus. In that technique, a ring is installed into an annular channel on the inner circumference of the discharge chamber. Leaf spring clips are attached to this ring and bias against the sound absorbing silencer pans. Flexibility in these springs allows for a minor amount of positional adjustment as the silencer pans bed themselves in against the discharge chamber wall. However, this construction can actually generate some noise. The silencer pans can vibrate against the chamber wall and springs because of flow-induced vibrations as the compressed gas passes over the springs. Because of relative motion between the ring and silencer pans, wear occurs in the anti-rotation pins that keep the ring in place in the annular channel. Wear can also occur in the springs and pans. This wear can lead to further loosening of the silencer pans.

It is desired to secure the silencer pans within the discharge chamber or volute in a manner that facilitates installation and avoids the foregoing problems caused by flow-induced vibrations. That is, it is desired to improve the fastening of the silencer pans and increase the reliability of the silencing arrangement.

Accordingly, it is an object of this invention to provide an improved silencer assembly for a centrifugal compressor, which avoids the drawbacks of the prior art.

Another object is to provide for securing of the silencer in a fashion that avoids flow-induced vibration.

A further object is to provide for direct attachment onto the wall of the compressor discharge chamber which avoids leakage of compressed refrigerant.

Still another object is to provide fastening means for the silencer pans which are as simple and straight forward as possible.

SUMMARY OF THE INVENTION

Briefly, in accordance with one aspect of the invention, the sound absorbing elements or silencers are positioned against a radially extending side wall of the discharge chamber, or volute, and are fastened to it by threaded bolts or machine screws which pass through openings that penetrate from outside the compressor to the inside of the discharge chamber. The bolts are received in respective threaded nipples that are disposed on a side of the silencer pans that faces the discharge chamber side wall, and which can project into the respective openings a short distance. The openings are of stepped diameters, with a narrow, distal portion through which the bolt or screw passes. Then a head of the bolt or machine screw and a washer rest on a shoulder of the opening. A wider part of the opening above the fastener head receives a threaded plug that carries a sealing ring and seals the opening against leakage of the compressed refrigerant.

The bolts draw the silencer pans snugly against the side wall of the discharge chamber. After an initial run-in period, the bolts can be snugged down additionally, if desired, to allow for bedding in. The respective plugs can be withdrawn and then reinstalled before and after this step.

By avoiding the leaf spring clip structure on the exposed side of the silencers, flow-induced vibration is significantly reduced.

In the Drawing as hereinafter described in detail, one preferred embodiment of the invention is depicted. Further objects, features, and advantages of this invention will become apparent from consideration of this embodiment, as described in connection with the accompanying Drawing.

DETAILED DESCRIPTION OF THE PREFERRED EMBODIMENT

Figure 1:
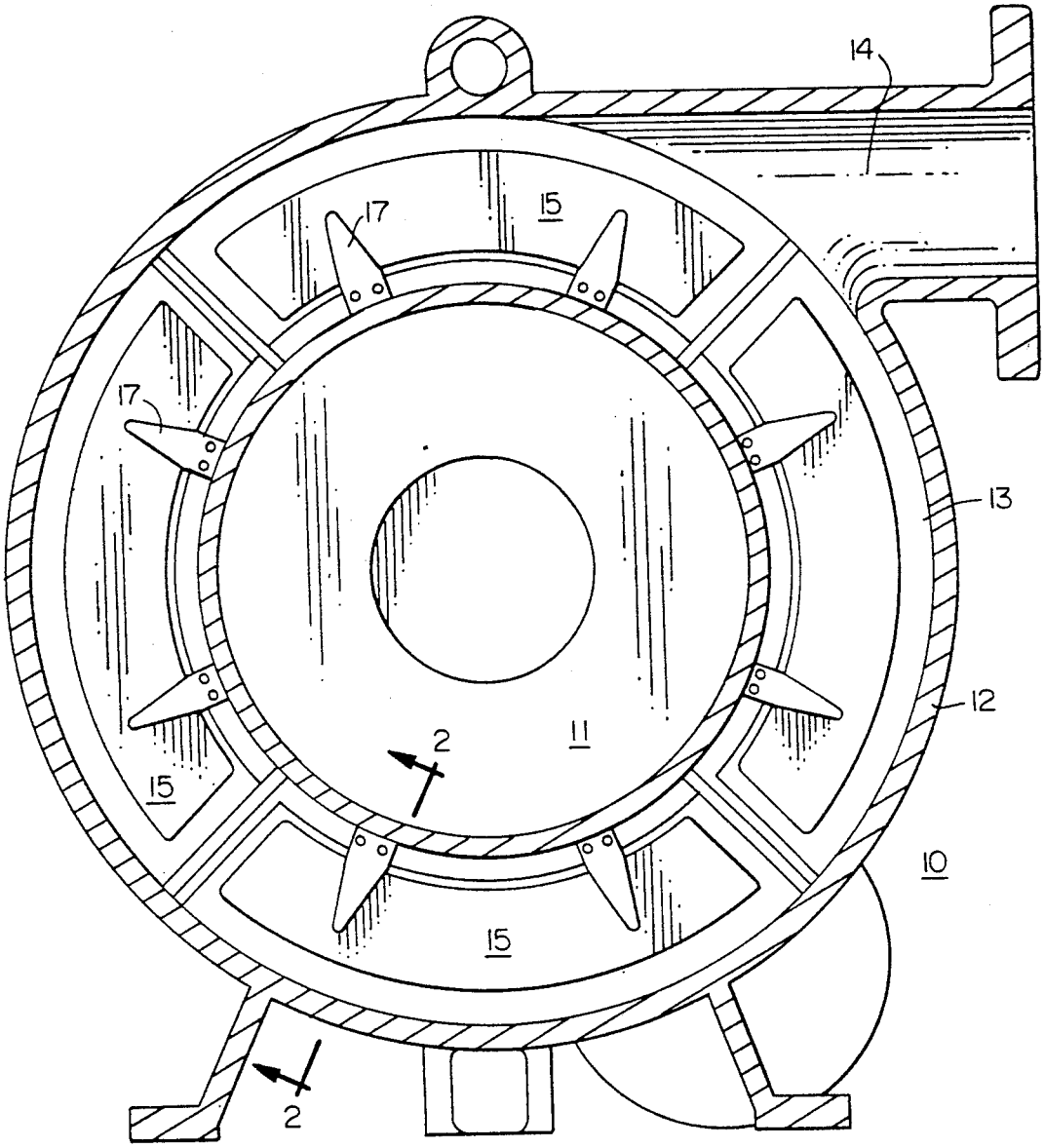
FIG. 1 Prior Art
FIG. 1 is an axial cross-sectional view of a collector portion of a centrifugal compressor of the prior art.
Figure 2:
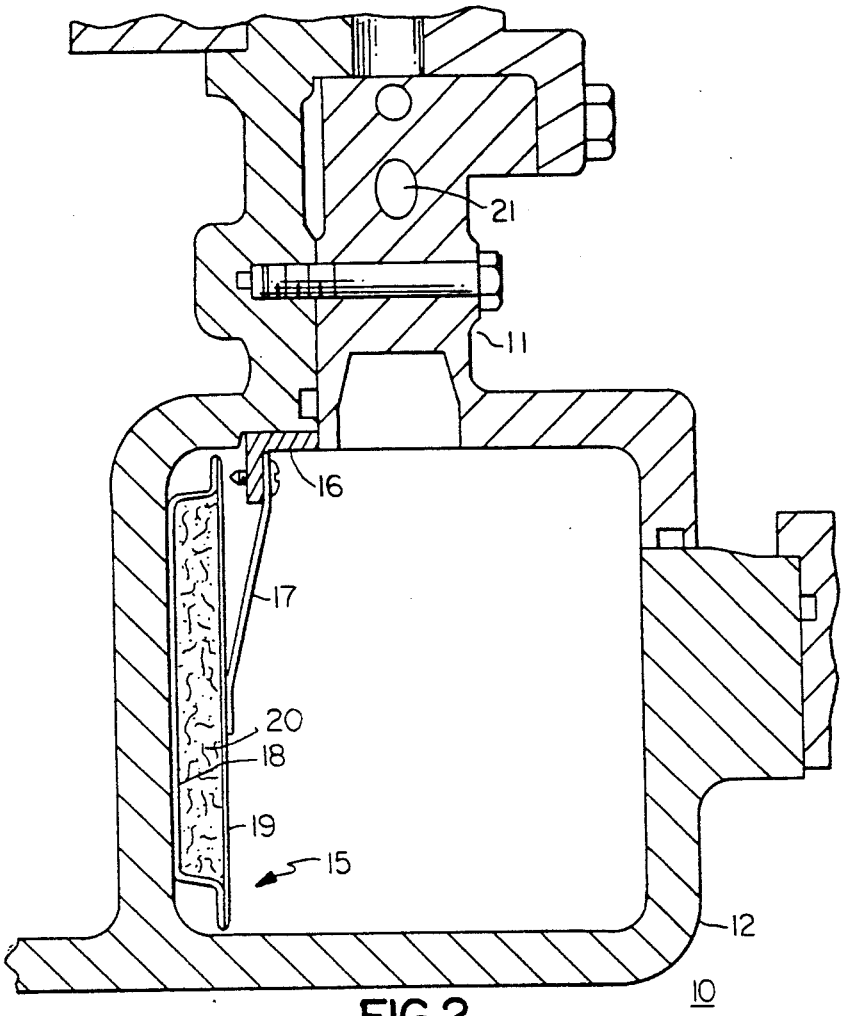
FIG.2 Prior Art
FIG. 2 is a partial axial section of a portion of the compressor as viewed at line 2—2 of FIG. 1.

With reference initially to FIGS. 1 and 2, a centrifugal compressor and silencer arrangement are briefly described to facilitate an understanding of the background of this invention, and to emphasize the improvement features thereof. As shown in these two Drawing Figures, a centrifugal compressor 10 and has an annular diffuser 11 disposed radially outside a centrifugal impeller (not shown). In the diffuser 11 kinetic energy is converted into pressure. The compressed gas passes from the diffuser into an annular collector or discharge chamber 13 formed within the housing or shell of the compressor 10. A discharge pipe 14 supplies the compressed gas from the discharge chamber 13 through a subsequent stage, e.g., to a condenser. In order to absorb noise that is produced by the impeller and other parts of the compressor, a plurality of sound absorbing silencer segments 15 are disposed against one side wall of the housing 12 within the annular discharge chamber 13. The silencer segments 15 are held in place by an assembly formed of a ring 16 on which are mounted a number of leaf spring clips 17. The ring 16 is held in place in the housing or shell 12 by the diffuser 11. The leaf spring clips 17 press against the respective silencer segments 15 to position them snugly against the wall of the discharge chamber.

As shown better in FIG. 2, each of the silencer segments is in the form of an arcuate metal pan or casing 18, having a perforated or screen like top plate 19. A sound absorbing pad 20 is sandwiched between the casing 18 and the top plate 19. FIG. 2 also shows a passageway 21 in the diffuser 11 which opens out into the discharge chamber 13.

Because of the need for the spring clips 17 and the ring 16 on which they are mounted, the choices are quite limited where the sound absorbing silencer segments 15 can be located within the chamber 13. The highly distorted flow in the collector passes over the leaf springs and silencer segments, giving rise to flow induced vibrations. Furthermore, the vibrations that are produced in the spring clips 17 can actually work to loosen the positioning of the pans or silencer segments 15 against of the wall of the discharge chamber 13.

Figure 3:
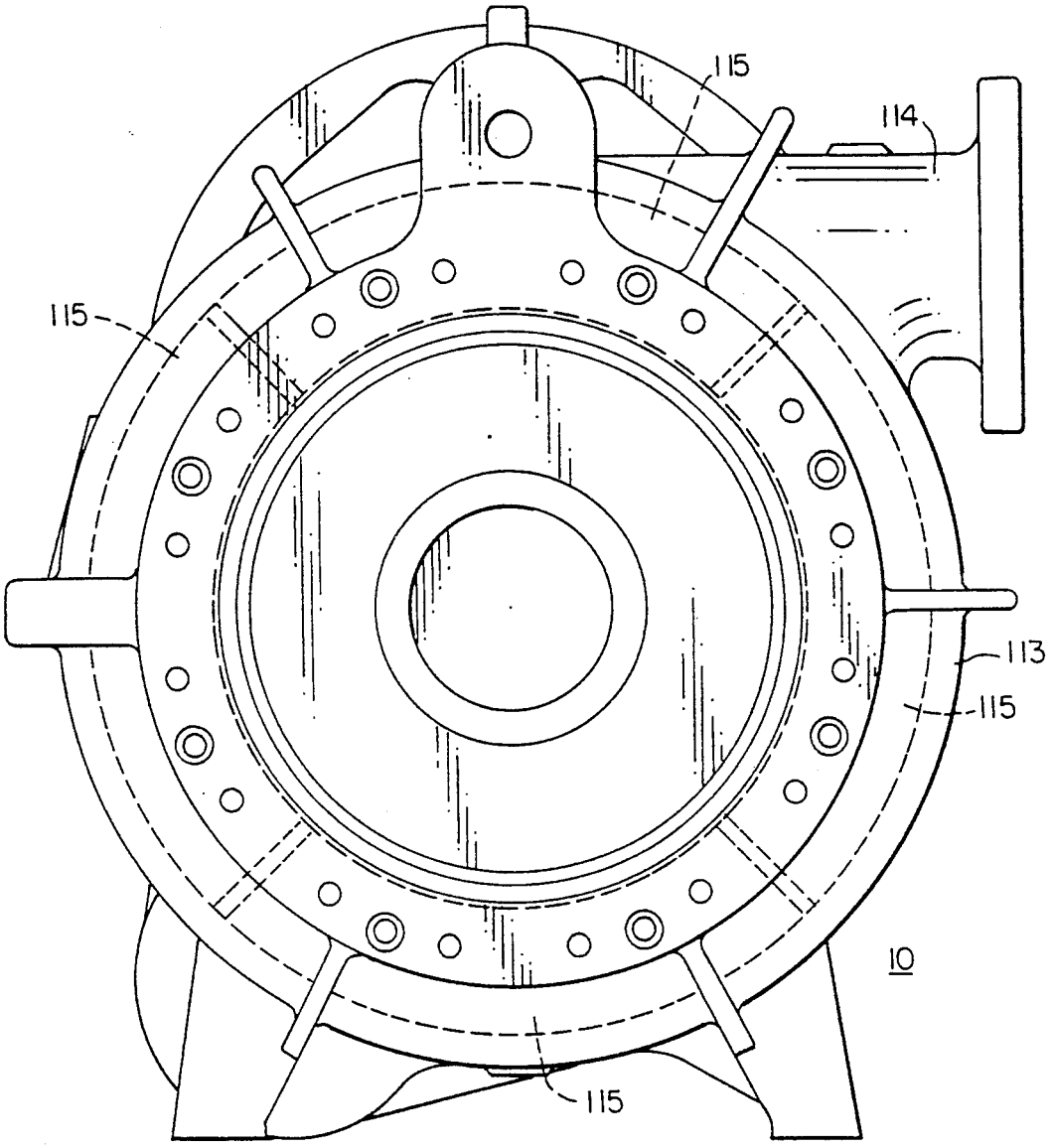
FIG. 3 is an enlarged axial cross-sectional view of the collector portion of a centrifugal compressor according to one preferred embodiment of this invention.

An improved silencer construction for the centrifugal compressor is illustrated in FIGS. 3-6, in which similar parts as described earlier are identified with similar reference numbers, but raised by 100. In this embodiment, as shown in FIG. 3, the centrifugal compressor 10 has an annular discharge chamber 113 that opens to a discharge pipe 114. A number of silencer segments 115 are situated within the discharge chamber 113 against a sidewall thereof, and these can have generally the same structure as the silencer segments 15 described previously.

Figure 4:
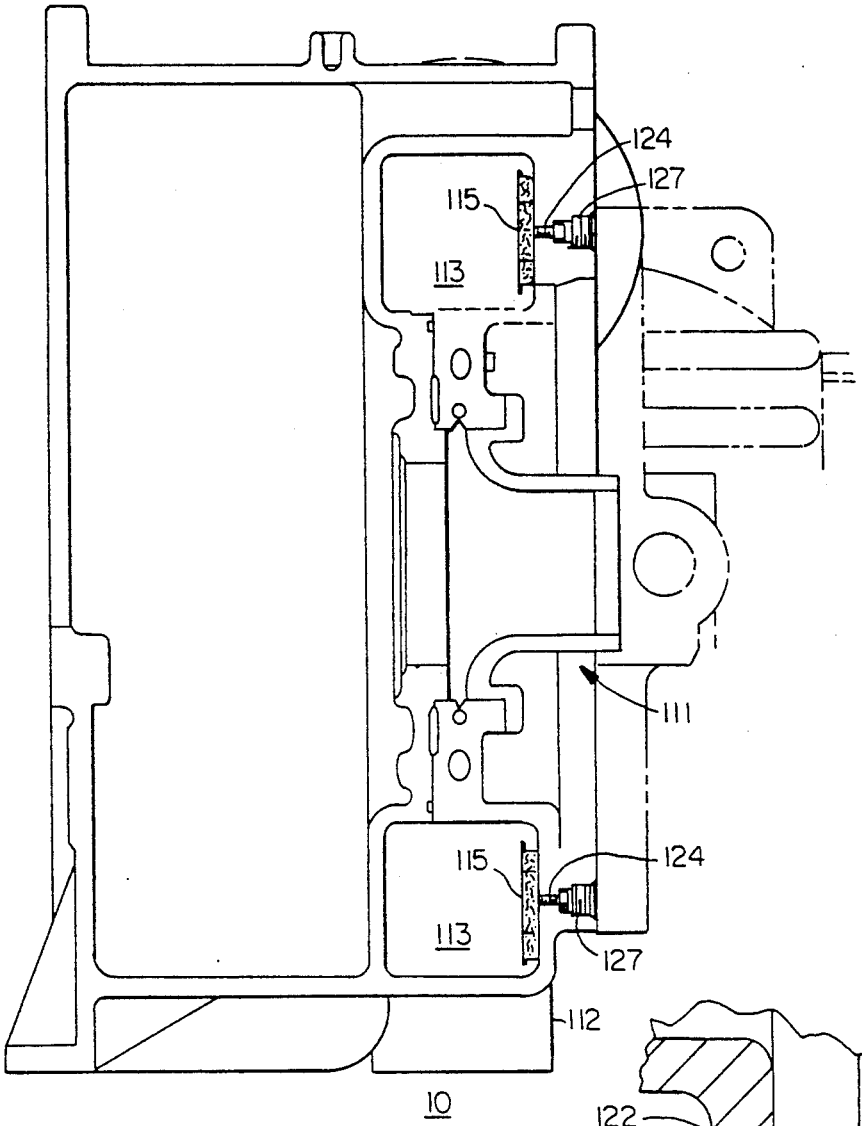
FIG. 4 is a cross sectional elevation of the compressor of FIG. 3.
Figure 5:
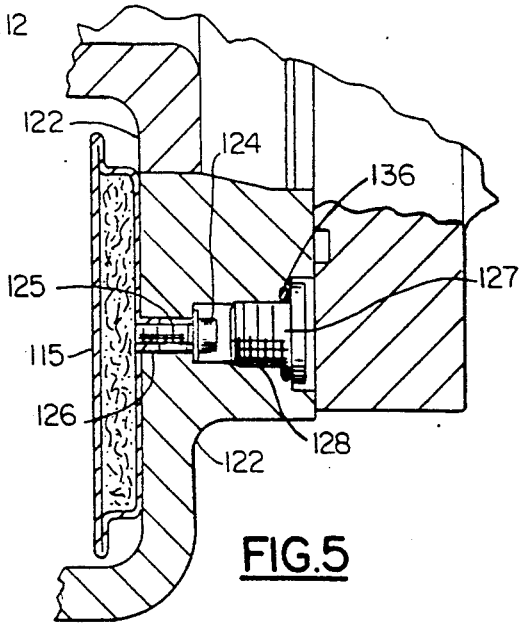
FIG. 5 is an enlargement of a portion of FIG. 4.

As illustrated in FIGS. 4 and 5, each of the silencer segments 115 is disposed against a radial side wall 122 of the discharge chamber, in this case, on the suction side of the compressor. This is opposite to the orientation of the prior-art arrangement of FIGS. 1 and 2. In this embodiment a threaded machine screw 124 penetrates through an opening 125 that extends through the wall 122 and is received into a female-threaded nipple 126 on the pan 119 of the associated silencer segment 115. Threaded plug 127 of a greater diameter of the head of the machine screw 124, fits into a wider proximal end 128 of the opening 125, and seals the same over the head of the machine screw 124. This arrangement prevents leakage of compressed refrigerant through the opening 125.

Figure 6:
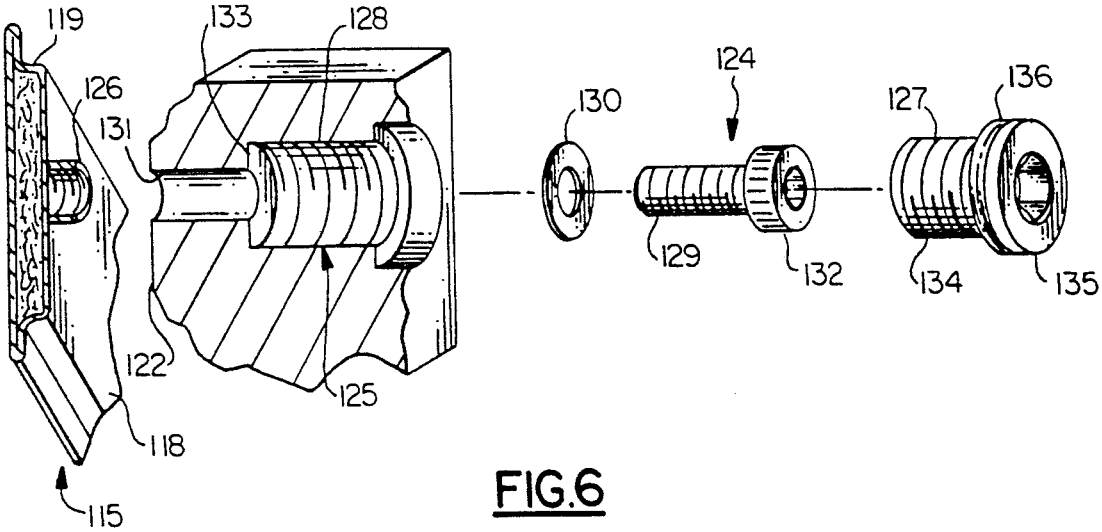
FIG. 6 is an exploded assembly view of operative portions of the embodiment of FIG. 3.

The installation of the silencer segments 115 into the compressor 110 is quite straightforward, as shown in the exploded assembly view of FIG. 6.

The machine screw 124 has threaded shaft 129 that is inserted first through washer 130 and then into the opening 125 to pass through a narrower distal portion 131 that opens on to the inside of the chamber 113. The associated nipple 126 of the silencer segment 115 also fits into the narrow portion 131 of the opening 125 A head 132 of the machine screw 124 biases against the associated washer 130, which in turn rests against a shoulder 133 of the opening 125.

After the machine screw 124 is tightened down snugly, the plug 127 is installed the wider, proximal portion 128 of the opening. Here, the plug 127 has a threaded distal portion 134 which mates with female threads in the opening proximal portion 128, and also has a proximal head flange 135. A neoprene rubber sealing o-ring 136 is fitted onto the plug 127 in an annular groove between the threaded distal portion 134 and the head flange 135. When the plug 127 is installed, the sealing ring 136 is squeezed against the proximal part 128 of the opening and seals against leakage of the refrigerant.

A small amount of resilience is afforded by the washer 130 so that the machine screw 124 will hold the silencer section 115 snugly, to accommodate bedding in of the pan 119 against the side wall 122 of the discharge chamber 113.

While specific fastening and sealing means have been shown in this embodiment, it is apparent that other alternative means could be employed. Also, while the silencer segments have been installed in a particular fashion on one preferred location, other shapes of silencers 115 could be employed, and could be installed at other locations within the discharge chamber 113.

The present invention has been described with particular reference to a preferred embodiment; however, the concepts of this invention are readily adaptable to other embodiments. Those skilled in the art may vary the structure thereof without departing from the basic scope and spirit of this invention, which is defined in the appended claims.

What is claimed is:

1. An improved centrifugal compressor of the type that includes a housing which defines an annular discharge chamber which receives a centrifugally driven refrigerant gas that has passed through a diffuser where gas kinetic energy has been converted to pressure; a plurality of sound absorbing elements positioned within said discharge chamber for absorbing sound energy from the compressed refrigerant gas in said discharge chamber; and retaining means for holding the sound absorbing elements in fixed positions within said discharge chamber; and the improvement wherein said retaining means comprise a plurality of threaded fastening members which each penetrate through an associated passage in a wall of said housing, with a distal end received into a corresponding threaded receptacle on a respective one of said sound absorbing elements, and a head at a proximal end thereof; a plurality of threaded plug members fitting in said passages above the heads of the threaded fastening members; and seal members carried on said plug members and compressed against walls of said passages by said plug members to seal the passages against leakage from said discharge chamber of the compressed refrigerant gas.

2. The improved centrifugal compressor as set forth in claim 1 wherein said sound absorbing elements are arc shaped segments circumferentially spaced against a side wall of said discharge chamber.

3. The improved centrifugal compressor as set forth in claim 1 wherein said threaded receptacles on said sound absorbing elements are female threaded nipples which project into the associated passages.

4. The improved centrifugal compressor as set forth in claim 1 wherein said passages each have a narrow distal portion in which a shaft of said threaded fastening member is disposed and a wider threaded proximal portion above the head of the threaded fastening member in which the respective plug member is fitted.

5. The improved centrifugal compressor as set forth in claim 4 wherein each said plug member has a distal threaded portion, a proximal head flange that projects radially beyond its threaded portion, and an annular receptacle between the head flange and the threaded portion; wherein said seal members each include a sealing ring positioned in said annular receptacles.

* * * * *